US005823118A

United States Patent [19]

Månström

[11] Patent Number: 5,823,118

[45] Date of Patent: Oct. 20, 1998

[54] BOTTOM DISCHARGE ARRANGEMENT

[75] Inventor: Hilding Månström, Luleå, Sweden

[73] Assignee: Luossavaara-Kiirunavaara AB, Lulea, Sweden

[21] Appl. No.: 836,448

[22] PCT Filed: Oct. 31, 1995

[86] PCT No.: PCT/SE95/01283

§ 371 Date: Jun. 26, 1997

§ 102(e) Date: Jun. 26, 1997

[87] PCT Pub. No.: WO96/15016

PCT Pub. Date: May 23, 1996

[30] Foreign Application Priority Data

Nov. 11, 1994 [SE] Sweden ..... 9403887

[51] Int. Cl.[6] ..... B61D 7/00

[52] U.S. Cl. ..... 105/284; 105/299; 105/240

[58] Field of Search ..... 105/240, 241.1, 105/241.2, 250, 253, 280, 284, 286, 288, 289, 290, 310, 311.1, 299

[56] References Cited

U.S. PATENT DOCUMENTS

| | | | |
|---|---|---|---|
| 3,167,026 | 1/1965 | Kemp | 105/250 |
| 3,316,859 | 5/1967 | Floehr | 105/253 |
| 3,452,886 | 7/1969 | Dorey | 105/290 |
| 3,611,947 | 10/1971 | Nagy | 105/253 |
| 3,786,764 | 1/1974 | Beer et al. | 105/240 |
| 3,818,842 | 6/1974 | Heap | 105/290 |
| 3,949,681 | 4/1976 | Miller | 105/284 |
| 4,222,334 | 9/1980 | Peterson | 105/250 |
| 4,366,757 | 1/1983 | Funk | 105/284 |
| 5,249,531 | 10/1993 | Taylor | 105/240 |

*Primary Examiner*—Mark Tuan Le
*Attorney, Agent, or Firm*—John Lezdey

[57] ABSTRACT

The invention relates to a bottom discharge arrangement intended for mounting on goods container of a railway truck. The arrangement includes at least one pair of flaps which is pivotally mounted on the goods container at their mutually remote edges, so as to be able to swing between an open and a closed position in a plane perpendicular to the edges. The arrangement includes a two-arm lever which is common to the link systems and which functions to maneuver the flaps simultaneously. The lever arm is pivotally mounted centrally at a point between the pivot axes of the flaps and is pivotally connected at one end to a first link pivotally mounted on one flap and at the other end is pivotally connected to a second link pivotally mounted on the other flap. When the flaps are closed, the pivot points between the parts of the link system lie in an essentially forceless state of equilibrium in a common plane which is locked in this state of equilibrium by an operating device coacting with the link system. The operating device functions to apply to the two-arm lever a turning moment around its attachment point so as to bring the link system out of its state of equilibrium and therewith allow the flaps to open.

6 Claims, 2 Drawing Sheets

BOTTOM DISCHARGE ARRANGEMENT

BACKGROUND OF THE INVENTION

1. Field of the Invention

The present invention relates to a bottom discharge arrangement intended for mounting to a goods containing space, preferably a goods container of an ore-transporting railway truck.

2. Description of the Prior Art

Known bottom discharge arrangements include so-called sliding flaps supported by carrier arms which in manoeuvering the sliding flaps are able to pivot about a journal pin located above a respective flap and preferably extending in the longitudinal direction of the truck. As the sliding flaps are manoeuvered, they swing laterally to the transverse direction of the truck and upwards, such as to describe a circular arc whose centre lies in the pivot axis. When opening and closing the sliding flaps will move along the truck periphery to a position on one side of the discharge opening, spaced from the journal pin. This solution is unsatisfactory, because the sliding flaps cannot be opened very quickly and because ore tends to collect on the flap surfaces and therewith prevent the truck from being emptied completely and/or makes subsequent closing of the flaps difficult to achieve. Furthermore, sliding flaps that are mounted in this way are unable to contribute towards guiding the flow of discharged goods into an offloading bin placed beneath the truck and between the wheels thereof.

In order to achieve a well-functioning and quick-operating bottom discharge arrangement in bottom-discharge ore carrying trucks, or bogies, there is a desire to use flaps which have the form of so-called drop flaps, i.e. flaps which when moved to their respective opening and closing positions do not follow a path along the periphery of the truck to a position on respective sides of the discharge opening, but flaps whose mutually remote edges are pivotally mounted on the bottom of the goods container and which can therefore be swung rapidly to an open position in a plane perpendicular to said edges. When closed, these flaps together form a continuous bottom surface against which the ore rests, and when open form a continuation of the mutually opposing wall parts of the goods container located above the flaps and therewith function to guide the ore down into the underlying bin.

It has been found convenient to use for manoeuvering the flaps of bottom discharge arrangements of ore-carrying trucks, or bogies, an eccentric mechanism which is able to lock the flaps in their closed position when moved to an "overkneed" position about a rotational centre.

U.S. Pat. No. -A-3,316,859 and U.S. Pat. No. -A-3,611,947 illustrate examples of bottom discharge arrangements that include an eccentric mechanism which takes a so-called overkneed position when the flaps are closed. It will be seen, however, that the flaps of these known bottom discharge arrangements are not drop flaps but sliding flaps, i.e. flaps which are carried by support arms and which are pivotal about a journal pin mounted above each flap. With this type of flap, no serious problems occur as a result of the negative forces that are generated in the manoeuvering mechanism by the weight of the goods being carried when the flaps are closed, because the weight of the ore is taken up essentially by the journal pins located above respective flaps and not by the flap operating mechanism as in the case of drop flaps.

U.S. Pat. No. -A-3,611,947 teaches a bottom discharge arrangement which includes a pair of drop flaps which are pivotally mounted on the goods container at their mutually remote edges and operated by means of a link system which is common to both flaps and which includes an eccentric mechanism in the form of a two-arm lever pivotally mounted between the flaps. Each end of the lever is pivotally connected to a respective flap by means of a link arm. The eccentric mechanism is in an overkneed position when the flaps are closed. With the intention of eliminating the problem of overcoming negative forces when unlocking the operating mechanism, the mechanism is constructed so that in the initial unlocking movement the flaps are moved horizontally from a position in which they are locked and cannot therefore be pivoted to an end position in which the flaps are able to pivot. This arrangement thus obviates the need to overcome the weight of the goods when opening the flaps, and the only force that need be overcome is the frictional force acting between the flaps and those parts of the arrangement that support the flaps.

One drawback with this arrangement is that it does not allow the flaps to open at the speed desired with the inventive bottom discharge arrangement. This is mainly due to the long movement path travelled by the mechanism from the closed position of the flaps to their upwardly swung position. Furthermore, the arrangement is structurally complicated and therewith sensitive to operational disturbances.

OBJECTS AND SUMMARY OF THE INVENTION

The object of the invention is to provide an improved bottom discharge arrangement for all trucks or bogies provided with drop flaps, so as to enable the flaps to be opened more quickly than with known arrangements. Another object of the invention is to provide a bottom discharge arrangement having an operating mechanism which will lock the flaps securely in their closed positions in spite of a very rapid flap-opening sequence.

These objects are achieved with a bottom discharge arrangement that has the features set forth in the following claims.

Because when the flaps are closed, the pivot points between the parts of the link system will lie in a generally forceless position of equilibrium in a common plane, this position of equilibrium being locked by a manoeuvering device provided in the link system, and because the device by means of which the flaps are manoeuvered to an open position is constructed to apply a rotational moment of force on the two-arm lever about its attachment point so as to bring the link system out of its state of equilibrium, no negative forces will occur as a result of the weight of the goods and thus no negative moment of forces will occur around the rotational centre of the operating mechanism. As a result of the construction of the inventive link system, forces that are generated in the links are guided towards the rotational centre and the force required to open the mechanism is therefore maintained essentially constant irrespective of the weight exerted by the goods.

BRIEF DESCRIPTION OF THE DRAWINGS

The invention will now be described in more detail with reference to a non-limiting embodiment thereof and also with reference to the accompanying drawings, in which.

DESCRIPTION OF THE PREFERRED EMBODIMENTS

Figure 1:
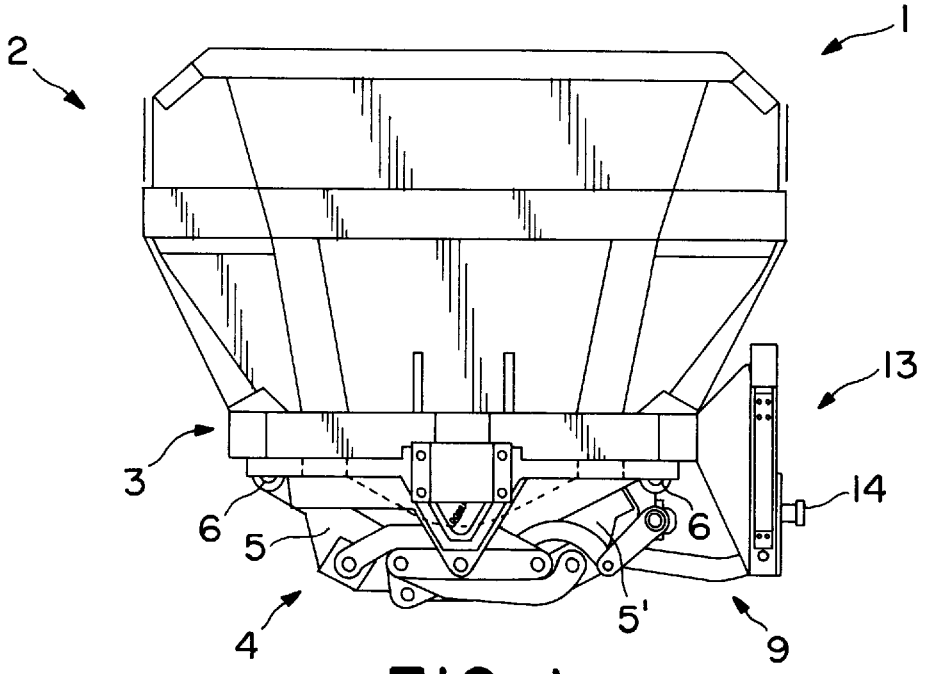
FIG. 1 is a front view (or rear view) of an ore truck which includes a bottom discharge arrangement constructed in accordance with the invention.
Figure 2:
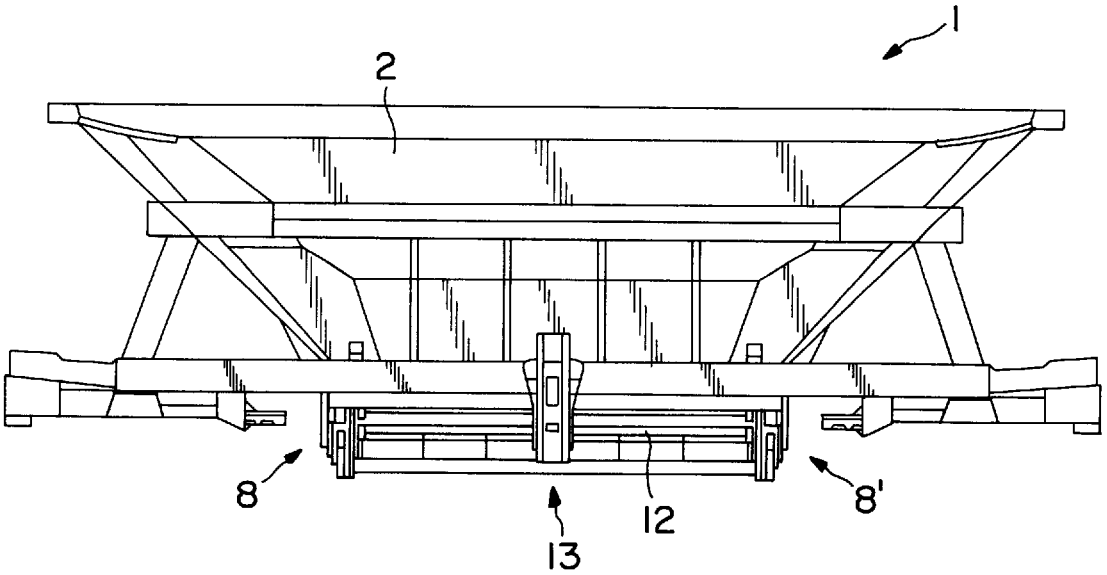
FIG. 2 is a side view of the ore truck provided with the bottom discharge arrangement according to FIG. 1.

The railway truck 1 illustrated in FIGS. 1 and 2 includes a goods container or basket 2 supported by an undercarriage 3. The truck 1 is intended to transport such goods as ore, coal, etc., and has provided at the bottom thereof an inventive bottom discharge arrangement 4. The arrangement 4 includes a pair of mutually identical flaps 5, 5' which, when closed, form a continuous and impervious bottom on which the ore rests and which, when open (FIG. 3) define an opening through which the ore is discharged to an underlying offloading bin (not shown) located between the truck wheels (not shown) while guiding the goods into the bin.

The bottom discharge arrangement 4 is mounted on the undercarriage 3 and on the goods container 2 and includes a frame 7 to which the flaps 5, 5' are pivotally connected along their mutually remote edges at 6, 6'. The bottom discharge arrangement further includes a link system 8 and 8' respectively on each end side of the flaps (see FIG. 2), said system being operative to guide the flaps in a plane perpendicular to said edges as the flaps 5, 5' are opened and closed.

The two link systems 8, 8' are mutually identical and are constructed to manoeuver the flaps 5, 5' simultaneously.

The link systems 8, 8' are manoeuvered simultaneously by means of an operating device 9 which includes for each link system an operating arm 10 which is pivotally connected at one end to the link system 8, 8' and at its other end to a respective link arm 11, 11', which is, in turn, attached to the respective end of a rotatably journalled axle 12 extending along the goods container 2.

Figure 3:
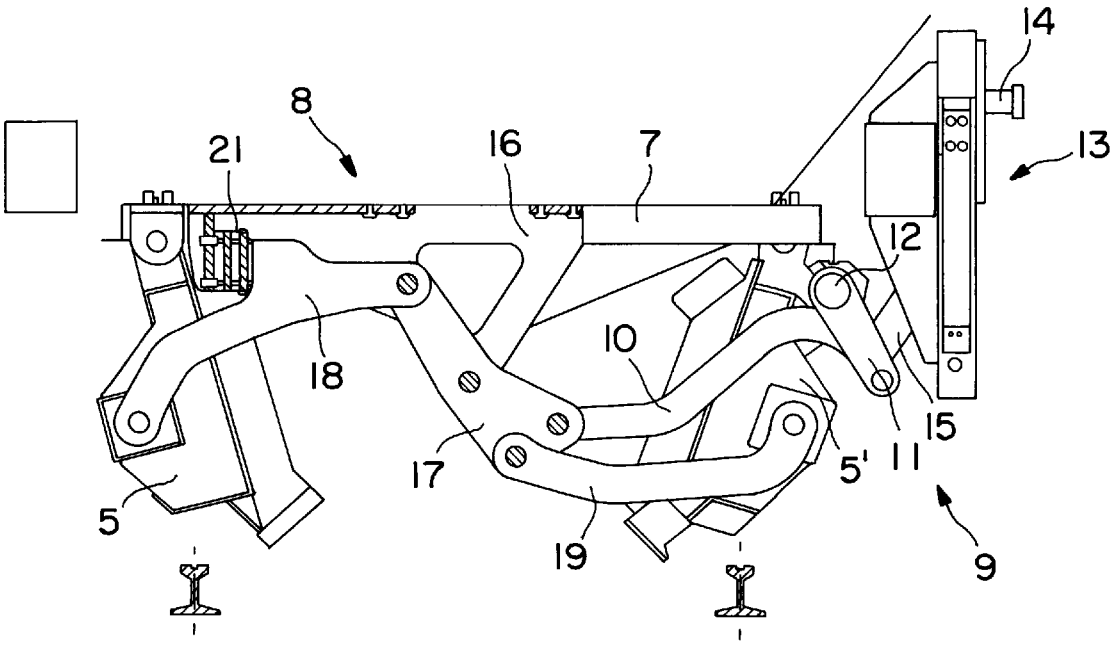
FIG. 3 is a schematic end view of one embodiment of a bottom discharge arrangement, showing the arrangement when open.

As will be seen from FIG. 3, the operating device 9 also includes a vertically arranged lifting device 13 which extends in the longitudinal direction of the truck and which includes a roller 14 for coaction with a guide path (not shown) arranged along the track plane. In the illustrated case, the lifting device 13 is located centrally between the link systems 8, 8', see FIG. 2.

Figure 4:
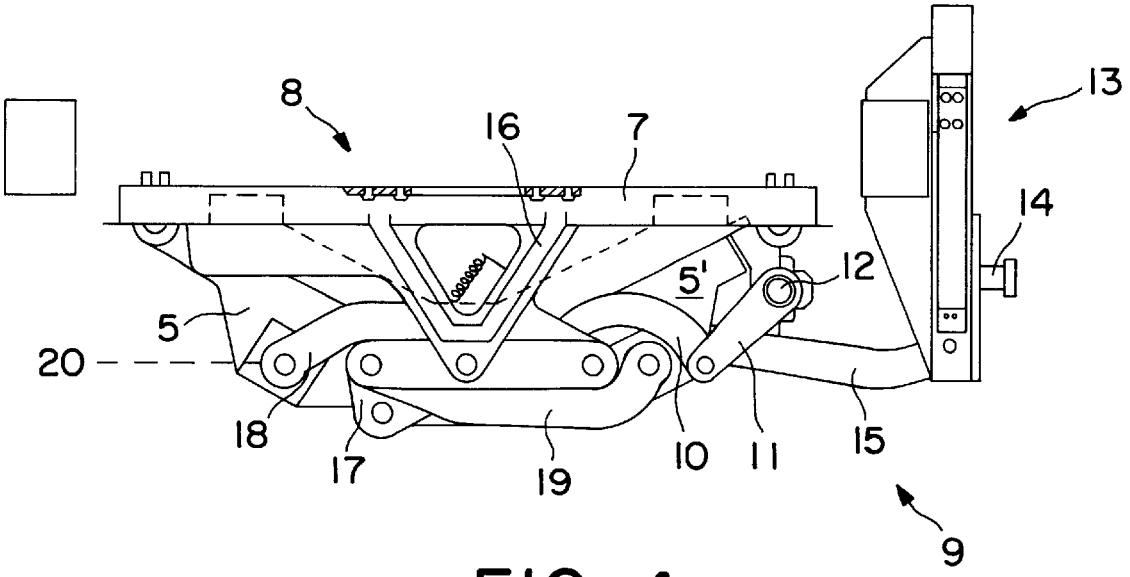
FIG. 4 illustrates the bottom discharge arrangement of FIG. 3 when closed.

As will be seen from FIGS. 3 and 4, the lifting device 13 includes a pivotal link-arm 15 which extends to a link arm (not shown) fixedly connected to the axle 12 and to which the link arm 15 is pivotally mounted. The link arm 15 and the link arm that is not shown are mutually arranged so that vertical movement of the roller 14 of the operating device from a lower end position to an upper end position will cause the axle 12 to turn anti-clockwise. Movement of the roller 14 from its upper end position to its lower end position will cause the axle 12 to turn in a clockwise direction.

Because the two link systems 8, 8' are identical to one another, only one of these link systems will be described in the following description.

As shown in FIGS. 3 and 4, the link 8 is placed outside the goods container 2 and includes a bearing block 16 in the region between said flaps 5, 5', for simultaneous manoeuvering of the flaps. The bearing block 16 is attached to the goods container 2 and has pivotally journalled thereon a two-arm lever 17 which is pivotally connected at each end to a respective flap 5, 5' through the medium of a link arm 18, 19.

For manoeuvering of the link system 8, one end of the manoeuver arm 10 is pivotally connected to one end of the two-arm lever 17, while the other end of the manoeuver arm is pivotally attached to the link arm 11, said link arm, in turn, being attached to the end of the axle 12 rotatably mounted on the goods container 2.

The pivotal point of the manoeuver arm 10 on the two-arm lever 17 is such as to enable torque to be applied to the two-arm lever 17 about its attachment point, thus moving the link system 8 out of its self-locking position.

The pivot points of the link arm 11 and the manoeuver arm 10 attached to the axle 12 are so positioned in relation to one another that rotary movement of the axle 12 in an anti-clockwise direction will cause the flaps 5, 5' to open, while rotary movement of the axle 12 in a clockwise direction will cause the flaps 5, 5' to close.

The illustrated embodiment of the bottom discharge arrangement 4 is designed for manoeuvering by means of the lifting device 13, which is described in more detail in SE 460 038. It will be understood, however, that the manoeuvering device which drives the link system 8 can be replaced with other types of drive systems known to the art, such as piston-cylinder systems for instance.

In order to lock the flaps 5, 5' when they move towards their respective closed positions, the links 17, 18, 19 of the link system 8 are angled in a manner best seen from FIG. 3. The pivotal connections between the links 18, 19 and the pivot point of the two-arm lever 17 are spaced apart such that the pivot points of all the parts included in the link system will be located in mutually spaced relationship along a line 20 (FIG. 4) which is common to said parts, when the flaps 5, 5' are closed.

When the flaps are closed, forces deriving from the intrinsic weight of the flaps 5, 5' and the ore resting on the flaps will act in the pivot points of the link system 8. The link system 8, and therewith also the link system 8', is designed to lead these forces to the rotational centre of the link system 8, i.e. towards the point at which the two-arm lever 17 rotates around the bearing block 16. Thus, no moments of force which act to open the flaps 5, 5' will occur in the links 17, 18, 19, and any increase in truck load will merely act to enhance locking of the link system 8.

One important advantage obtained when arranging the pivot points in a manner such that said points will lie on a common line when the flaps 5, 5' are closed instead of allowing the pivot points to adopt a so-called overknee position, is that the self-locking effect can be nullified with the application of a much smaller force and through a much shorter movement path. This facilitates and accelerates opening of the flaps 5, 5' of the bottom discharge arrangement. The drawback with a link system designed so that the pivot points will take an overknee position when the flaps are closed resides in the occurrence of negative forces in the system as a result of the influence exerted by the load. In the case of such a link system, it is necessary to apply force to overcome said generated negative forces when unlocking the link system, in addition to the force normally required to unlock a link system in which the pivot points are not overkneed. The larger forces required for manoeuvering the link system in this case require the provision of larger-sized link arms and substantially longer lever arms, resulting in a more bulky link system.

The flaps are opened by moving the roller 14 on the lifting device 13 from its lower to its upper position (FIGS. 3 and 4). The manner in which the roller 14 is moved is described in more detail in publication SE 460 038 mentioned above. As the roller 14 moves upwards, the axle 12 is rotated by the link arm 15. As the axle 12 rotates, the link arm 11 is activated and, in turn, causes the two-arm lever 17 to rotate anti-clockwise, through the medium of the manoeuver arm 10.

It will be seen from FIG. 4 that the operating device 9 is also in a locked position when the flaps 5, 5' are closed, wherein the roller 14 on the lifting device 13 of the operating device 9 is located in its bottom end position. This locked state of the arrangement, achieved by the construction of the links 10, 11, 15 and their mutually selected pivot points, can only be released by causing the roller 14 to move towards its upper end position.

When the two-arm lever 17 is turned anti-clockwise, there is generated a moment of force which, by virtue of the direction in which it acts, forces the pivot points between the links 17, 18, 19 of the link system out of their locked positions and therewith release the link system 8.

It will be understood from the description referring to FIGS. 3 and 4 that the links 17, 18, 19 of the link system 8 adopt a forceless state of equilibrium when the flaps 5, 5' are closed. As the flaps move from their closed position (FIG. 4) towards their open position (FIG. 3) in response to rotation of the two-arm lever 17, the pressure exerted on the flaps by the goods contained in the goods container 2 will assist in opening the flaps 5, 5'.

Although not shown, the mutually proximal edges 21 of the flaps 5, 5' form a goods labyrinth when closed, therewith making it difficult for the goods to escape between the flaps 5, 5'.

To achieve soft and gentle opening of the flaps 5, 5', one of the links 13 is provided with a surface for abutment with an elastomeric damping element 21, abutment element, attached to the goods container 2.

It will be understood that the illustrated embodiment of the inventive bottom discharge arrangement in which the pivot points are arranged to lie on a common line does not limit the way in which the link system 8 can be locked. For instance, the link system can be constructed in a way in which the links take a slightly overkneed position when the flaps are closed or a slightly instable position in which they are locked by the operating device, both alternatives lying within the scope of the inventive concept. It will also be understood that it lies within the scope of the inventive concept to construct the bottom discharge arrangement in a manner which will enable the flaps to be manoeuvered by means of a single link system which acts on one flap. Such a bottom discharge arrangement, however, would be larger in size and therewith more bulky.

What is claimed is:

1. A bottom discharge arrangement mounted to a structure having a goods containing space said arrangement comprises at least one pair of flaps which are pivotally mounted on the goods container at their mutually remote edges so as to be able to swing between an open and a closed position in a plane perpendicular to said edges, the mutually opposing edges of the flaps lying sealingly against one another when the flaps are closed, said flaps when open generally form extensions of the opposing wall parts of the goods container located above the flaps said arrangement including a link system which is common to said flaps and which functions to maneuver the flaps simultaneously, said link system including a two-arm lever which is pivotally mounted at its center to an axle which is fixed in relation to said space and which is located centrally between the pivot axes of said flaps, and wherein one end of the two-arm lever is pivotally connected to a first link pivotally mounted on one of the flaps, and the other end of said lever is pivotally connected to a second link pivotally mounted on the other one of the flaps , when said flaps are closed, all pivoting points of said two-arm lever, first link and second link lie in an essentially forceless state of equilibrium in a common plane, wherein said state of equilibrium is locked by means of an operating device coacting with the link system; and in that the operating device is a means connected to the two-arm lever for turning said two-arm lever about said axle to bring the link system out of its state of equilibrium and therewith allow the flaps to open.

2. The arrangement according to claim 1, wherein the operating device includes a third link which is pivotally connected to the other end of the two-arm lever and the free end of said third link being connected to a maneuvering link, wherein when the flaps are closed the pivot point between the third link and the maneuvering link will lie in said plane; and wherein when the flaps are closed the pivot point between the third link and the two-arm lever is located in a plane beneath the pivot axis of said pivot point, fixed in relation to the space, so as to enable a flap-opening turning moment to be applied to the two-arm lever.

3. The arrangement according to claim 2, wherein the arrangement includes a vertically extending lifting device which extends in the longitudinal direction of said structure; said structure including a track plane, and wherein said lifting device including a roller that can move between a bottom and a top end position by virtue of its coaction with a guide rail arranged in said track plane of said structure; and in that the roller has connected thereto a link arm which is pivotally connected to the maneuvering link and which functions to lock said maneuvering link when the roller is in its bottom end position.

4. The arrangement of claim 1 wherein said structure having said goods containing space comprises a goods container of an ore transporting railway truck.

5. The arrangement of claim 1 wherein said structure, has a goods container which is a basket supported by an undercarriage.

6. The arrangement of claim 5 wherein the arrangement is mounted on the undercarriage and includes a frame to which said flaps are pivotally connected.

* * * * *